US009711319B2

(12) United States Patent
Zigler et al.

(10) Patent No.: US 9,711,319 B2
(45) Date of Patent: Jul. 18, 2017

(54) SYSTEM FOR FAST IONS GENERATION AND A METHOD THEREOF

(71) Applicants: YISSUM RESEARCH DEVELOPMENT COMPANY OF HEBREW UNIVERSITY OF JERUSALEM, LTD., Jerusalem (IL); HIL APPLIED MEDICAL LTD., Omer (IL)

(72) Inventors: Arie Zigler, Rishon Le Tzion (IL); Shmuel Eisenmann, Tel Aviv (IL); Tala Palchan, Jerusalem (IL); Sagi Brink-Danan, Jerusalem (IL); Eyal Gad Nahum, Jerusalem (IL)

(73) Assignees: YISSUM RESEARCH DEVELOPMENT COMPANY OF THE HEBREW UNIVERSITY OF JERUSALEM, LTD., Jerusalem (IL); HIL APPLIED MEDICAL LTD., Omer (IL)

( * ) Notice: Subject to any disclaimer, the term of this patent is extended or adjusted under 35 U.S.C. 154(b) by 0 days.

(21) Appl. No.: 15/237,681

(22) Filed: Aug. 16, 2016

(65) Prior Publication Data

US 2016/0351369 A1 Dec. 1, 2016

Related U.S. Application Data

(63) Continuation of application No. 14/963,340, filed on Dec. 9, 2015, which is a continuation of application (Continued)

(51) Int. Cl.
*H01J 27/02* (2006.01)
*H01J 27/24* (2006.01)

(52) U.S. Cl.
CPC ..... *H01J 27/24* (2013.01)

(58) Field of Classification Search
None
See application file for complete search history.

(56) References Cited

U.S. PATENT DOCUMENTS 3,294,970 A * 12/1966 Jenckel ..... H01J 17/00 250/423 R
4,199,685 A * 4/1980 Hora ..... B01D 59/34 250/423 P (Continued)

FOREIGN PATENT DOCUMENTS

JP 2002107494 A * 4/2002
JP 2002107499 A * 4/2002

(Continued)

OTHER PUBLICATIONS

Palchan et al., ("Efficient coupling of high intensity short laser pulses into snow clusters" Appl. Phys. Le Ft., vol. 90. No. 4, Jan. 24, 2007 (Jan. 24, 2007), pp. 041501-1-041501-3, XP002579658 New York.).*

(Continued)

*Primary Examiner* — Andrew Smyth
(74) *Attorney, Agent, or Firm* — Manelli Selter PLLC; Edward J. Stemberger

(57) ABSTRACT

The present invention discloses a system and method for generating a beam of fast ions. The system comprising: a target substrate having a patterned surface, a pattern comprising nanoscale pattern features oriented substantially uniformly along a common axis; and; a beam unit adapted for receiving a high power coherent electromagnetic radiation beam and providing an electromagnetic radiation beam having a main pulse and a pre-pulse and focusing it onto said patterned surface of the target substrate to cause interaction between said radiation beam and said substrate enabling creation of fast ions.

7 Claims, 11 Drawing Sheets

Related U.S. Application Data

No. 13/752,426, filed on Jan. 29, 2013, now Pat. No. 9,236,215, which is a continuation-in-part of application No. 13/140,377, filed as application No. PCT/IL2009/001201 on Dec. 20, 2009, now Pat. No. 8,389,954.

(60) Provisional application No. 61/138,533, filed on Dec. 18, 2008, provisional application No. 61/592,935, filed on Jan. 31, 2012, provisional application No. 61/697,314, filed on Sep. 6, 2012.

(56) References Cited

U.S. PATENT DOCUMENTS 5,622,567 A * 4/1997 Kojima ..... C23C 14/022 118/726
6,787,723 B2 * 9/2004 Pronko ..... B01D 59/44 204/157.2
6,867,419 B2 * 3/2005 Tajima ..... H05H 7/16 250/423 P
6,906,338 B2 * 6/2005 Tajima ..... H05H 15/00 250/396 R
6,958,480 B1 * 10/2005 Iyer ..... B01J 20/103 250/340
7,317,192 B2 * 1/2008 Ma ..... G21K 1/08 250/298
7,420,687 B2 * 9/2008 Pfaff ..... G01R 15/241 356/457
7,430,351 B2 * 9/2008 Albert ..... G02F 1/3511 349/169
7,704,684 B2 * 4/2010 Rogers ..... B82B 3/00 430/325
7,728,958 B2 * 6/2010 Pfaff ..... G01R 15/241 356/35.5
7,782,914 B2 * 8/2010 Faure ..... H05H 15/00 372/25
2002/0090194 A1 * 7/2002 Tajima ..... H05H 15/00 385/147
2003/0029735 A1 * 2/2003 Garvey ..... B82Y 30/00 205/768
2004/0013820 A1 * 1/2004 Cadieu ..... C23C 14/221 427/596
2004/0069960 A1 * 4/2004 Maldonado ..... B82Y 10/00 250/492.24
2006/0050366 A1 * 3/2006 Kong ..... H01S 3/2333 359/337
2006/0215712 A1 * 9/2006 Ziener ..... H05G 2/003 372/2
2009/0230318 A1 * 9/2009 Fourkal ..... G21B 1/19 250/423 R

FOREIGN PATENT DOCUMENTS

JP 2006226790 A * 8/2006
JP 2009014671 A * 1/2009

OTHER PUBLICATIONS

Palchan et al., ("Generation of fast ions by an efficient coupling of high power laser into snow nanotubes" Applied Physics Letters, vol. 91, No. 25, Dec. 18, 2007 (Dec. 18, 2007), pp. 251501-1-251501-3, XP002579654, New York.).*
Zhidkov et al. ("Direct spectroscopic observation of multiple-charged-ion acceleration by an intense femtosecond-pulse laser". Physical Review E, vol. 60, No. 3, Sep. 1999, pp. 3273-3278).*

* cited by examiner

SYSTEM FOR FAST IONS GENERATION AND A METHOD THEREOF

RELATED APPLICATIONS

This is a continuation of application Ser. No. 14/963,340 filed Dec. 9, 2015 which is a continuation of application Ser. No. 13/752,426, filed Jan. 29, 2013, now U.S. Pat. No. 9,236,215, issued on Jan. 12, 2016 which is a continuation-in-part of application Ser. No. 13/140,377, filed Jun. 16, 2011, now U.S. Pat. No. 8,389,954, issued on Mar. 5, 2013, which is a 35 USC 371 application of PCT/IL2009/001201, filed Dec. 20, 2009, and entitled to the benefit of U.S. provisional application 61/138,533, filed Dec. 18, 2008; application Ser. No. 13/752,426 is entitled to the benefit of U.S. provisional applications 61/592,935, filed Jan. 31, 2012 and 61/697,314 filed Sep. 6, 2012, all of which are incorporated herein by reference.

FIELD OF THE INVENTION

This invention relates to a system for generating fast ions and a method thereof.

BACKGROUND OF THE INVENTION

Fast ion beams are of interest for various applications including production of radioactive isotopes, neutron production radiography, fusion, and various forms of radiation therapy.

Beams of fast ions are typically produced in accelerators of various configurations such as cyclotrons or synchrotrons. Accelerators are relatively large and expensive machines that are costly to run and maintain. The development of lasers that are capable of providing extremely high intensities and electric fields has stimulated research in exposing matter to laser light electric fields to generate fast ions and interest in using lasers to provide relatively inexpensive fast ion sources.

U.S. Pat. No. 6,906,338 describes using laser pulses "having a pulse length between approximately 1 to 500 femtoseconds (fs)" focused to energy densities of between about $10^{18}$ to about $10^{23}$ Watts/cm$^2$ (W/cm$^2$) to produce a high flux of energetic ions such as protons that may be used for medical purposes. The pulses are directed to interact with targets of various designs and provide radiation components that "include different species of ions (e.g., protons), x-rays, electrons, remnants of the pulse 102, and different energy components (e.g., MeV, 10's MeV, and 100's MeV within a certain energy band of window)". The targets may comprise a thin foil layer for absorbing pre-pulse energy of the pulses. A beam transport system allows ions such as protons, produced in the target and having a predetermined beam emittance and energy to propagate to a "treatment field" for therapeutic applications. The patent describes targets that are concave on a side of the target downstream relative to a propagation direction of the laser pulses and may be formed having grooves, or comprising fibers, clusters, or foams. "The size of grooves, 402, fibers 404, clusters 406 or foams 408 may be designed to be shorter than the size of electron excursion in the pulse field (less than approximately 1 micron)".

General Description

An article, "Efficient Coupling of High Intensity Short Laser Pulses into Snow Clusters"; by T. Palchart et al; Applied Physics Letters 90, 041501 (2007); published online 24 Jan. 2007 by some of the same inventors of the present invention, the disclosure of which is incorporated herein by reference, describes coupling intense laser light to a target comprising "elongated snowflakes smaller in diameter than the laser wavelength". The snowflakes are formed on a sapphire ($Al_2O_3$) substrate located in a vacuum chamber and cooled to less than −70° C. The inventors found that about 94% of the energy in pulses of laser light or wavelength at 800 nm focused on the snowflakes to intensities between about $1\times10^{15}$ W/cm$^2$ to about $2\times10^{16}$ W/cm$^2$ was absorbed by the snowflakes. The pulses had a pulse width of about 150 fs and a contrast ratio of about $10^{-3}$.

Another article "Generation of Fast Ions by an Efficient Coupling of High Power Laser into Snow Nanotubes"; by T. Palchan et al; Applied Physics Letters 91, 251501 (2007); published online December 2007 by some of the same inventors as inventors of the present invention, describes "generation of fast ions during interaction of a short laser pulse at moderate intensity, $1\sim10^{16}\cdot10^{17}$ W/cm$^2$, with snow nanotubes". The article, the disclosure of which is incorporated herein by reference, notes that H-like and He-like oxygen having kinetic energy up to 100 keV were generated in the interaction. The target of snow nanotubes "were snow clusters . . . grown by depositing $H_2O$ vapor into vacuum onto 1 mm thick sapphire ($Al_2O_3$) plate at a temperature of 100 K. The snow clusters were randomly deposited to form a layer on the sapphire substrate about 100 microns thick and comprised "elongated cluster with characteristic size in the range of 0.01-0.1 μm".

The inventors have found that for a given intensity of high power coherent electromagnetic radiation, a non-oriented target (7) such as described in the articles referenced above, interacting with the radiation beam tends to produce relatively large fluxes of relatively high energy ions.

The inventors have now created oriented patterned targets (OPT) and investigated the interaction of such oriented patterned target (OPT) with incident electromagnetic radiation. The pattern on a surface of the target substrate has pattern features having certain longitudinal axes (so-called "elongated features") which are uniformly oriented along a certain common axis. Such pattern features of the OPT may be constituted by wire-like elements, nano-wires, elements, etc. These oriented pattern features present roughness on the OPT surface, which roughness may or may not be implemented as a continuous-surface relief.

The use of such OPT allows for optimizing parameter(s) of the incident electromagnetic radiation to enhance the efficiency of the radiation coupling into the OPT contributing to creation of fast ions with high kinetic energy. Such optimizable parameters include an angle of incidence of a beam of electromagnetic radiation onto the OPT surface and/or polarization of the incident beam. As will be described further below, the angle of incidence is a so-called "grazing angle", i.e. angle less than 45° between the beam propagation axis and the OPT surface (or higher than 45° in the meaning of "incident angle" being an angle between the beam propagation axis and the normal to the OPT surface). It should be understood that the optimal value of the gracing angle (magnitude as well as azimuth and elevation) should be appropriately selected and/or gradually varied, in accordance with the critical dimensions of the pattern (including the depth of pits), as well as the direction of orientation, to achieve the generation of an optimal fast ion beam.

As for the polarized electromagnetic radiation e.g. linear polarized light, it should be understood that this means light having a predetermined preferred polarization direction. The polarization direction has been selected relatively to the orientation axis of the OPT, and the fluxes and the energy of the ions, seem to be enhanced in comparison with non-oriented targets (T). Therefore, using an OPT target is more efficient than using T targets for producing relatively fast ions at relatively large fluxes.

It should be understood that, a target comprising randomly oriented filaments is referred to as a "target (T)", and that a target having a surface pattern exhibiting a preferred direction of orientation is referred to as an "oriented patterned target (OPT)".

In particular, a laser pulse having intensity between about $5\times10^{19}$ W/cm$^2$ and about $5\times10^{21}$ W/cm$^2$ interacting with an OPT target, would produce a burst of protons having energy between about 20 and 200 MeV. The burst may comprise more than $10^6$ protons, more than $10^7$ protons; more than $10^8$ protons, more than $10^9$ protons or even $10^{10}$ protons.

Therefore, the present invention provides a new system and method for generating fast ions (a beam of fast ions). The system comprises a target substrate having a surface relief with nanoscale feature (i.e. roughness) (i.e. a patterned surface, the pattern comprising nanoscale pattern features) oriented substantially homogeneously/uniformly along a certain axis/s common axis (i.e. having a predetermined direction of orientation) and a beam unit to be used with a high power coherent electromagnetic radiation source laser); the beam unit being adapted to receive a high power coherent electromagnetic radiation beam and to focus the radiation beam onto the patterned surface of the largest substrate to cause interaction between the radiation beam and the substrate enabling creation of fast ions.

In some embodiments, the team unit is adapted to direct the electromagnetic radiation beam onto the patterned surface of the target substrate with a predetermined grazing angle. The grazing angle is selected in accordance with the pattern such that the interaction provides an efficient coupling between the radiation beam and the substrate enabling creation of fast ions of desirably high kinetic energy.

It should be noted that generally, the grazing angle refers to the angle between the beam and the surface. i.e. 90° minus the angle of incidence. In some embodiments, the grazing angle is lesser than 45°. In some embodiments, the grazing angle is in the range of about 20°-40° (i.e. angle of incidence 50°-70°).

In some embodiments, the electromagnetic beam has a pre-defined polarization direction defining a certain angle between the polarization direction and the orientation axis of the pattern features of the target substrate is selected such that the interaction provides an efficient coupling between the radiation beam and the substrate enabling creation of fast ions having a desirably high kinetic energy.

Thus, an angle between a polarization direction of the beam of electromagnetic radiation and the orientation axis of the pattern features of the target substrate, and the grazing angle are selected such that interaction between the radiation beam and the substrate provides an efficient coupling between the radiation beam and the substrate enabling creation of fast ions. By this, the invention enables providing ion sources producing ions in relatively large quantities. In some embodiments, the angle between the polarization direction and the orientation axis is in a range of 0°-30°.

The system of the present invention provides fast ions having kinetic energy about equal to or greater than at least one of 5 MeV; 50 MeV; 100 MeV; 150 MeV; 200 MeV.

In some embodiments of the invention, the ions comprise protons. In some embodiments of the invention, the ions comprise Oxygen ions.

In some embodiments of the invention, the system comprises a beam unit configured and operable to selectively adjust the direction of polarization to different angles relative to the direction of orientation of the OPT.

According to some embodiments of the invention, the radiation beam comprises polarized beam having a desired direction of polarization relative to the direction of orientation of the OPT. In some embodiments, the polarization direction is substantially parallel to the orientation axis.

In some embodiments, the beam unit is configured to orient the polarization direction such that the polarization direction is substantially parallel to the direction of orientation.

In other embodiments, the beam unit is configured to orient the polarization direction such that the polarization direction has a relatively small angle (0°-30°) to the direction of orientation.

In some embodiments of the invention, the beam unit is configured and operable to focus the radiation beam to a spot size in the target for which the beam has a maximum intensity about equal to or greater than at least one of $10^{16}$ W/cm$^2$; $10^{17}$ W/cm$^2$; $10^{18}$ W/cm$^2$; $10^{19}$ W/cm$^2$, $10^{20}$ W/cm$^2$, $10^{21}$ W/cm$^2$.

In this connection, it should be understood that, an electric field produced by a laser beam with intensity $$I\frac{\mathrm{W}}{\mathrm{cm}^2}$$

is $$E \approx 27\sqrt{I}\,\frac{v}{\mathrm{cm}}.$$

for a short powerful laser beam of $10^{12}$ Watt focused to a spot diameter of 5 microns, an electric field of about $$6\times10^{10}\,\frac{v}{\mathrm{cm}}$$

is generated at the focal region. This field is larger than the electric field binding the electrons in the Hydrogen atom. Therefore, while interacting, the electrons are photo-ionized through one of three mechanisms. The dominant process would depend on the laser intensity and ionization potential. The first mechanism is a multi-photon ionization mechanism in which a number of photons hit the atom simultaneously to overcome the energetic gap need for ionization (one photon of 800 nm beam has about 1.5 eV). The second mechanism is a tunnel ionization mechanism in which the atom's electric field is distorted by the laser beam and the probability of an electron to tunnel is non negligible due to the reduced potential barrier. The third mechanism is an ionization mechanism over the barrier in which the electric field of the laser beam is large compared to the ionization potential in which the electrons are essentially free and gain kinetic energy from the laser electric field. The Keldysh parameter which is defined by $$\gamma = \sqrt{\frac{I_p}{2E_p}},$$

where $I_p$ is the ionization potential and $$E_p = 9.33738 \times 10^{-8} I\left[\frac{TW}{\text{cm}^2}\right]\lambda[\text{nm}]$$

is the ponderomotive potential. When $\gamma >> 1$ multi-photon ionization is the dominate mechanism for ionization. In the present invention, the radiation beam at the focal point on the target has a maximum intensity about equal to or greater than at least one of $10^{16}$ W/cm$^2$, $10^{17}$ W/cm$^2$, $10^{18}$ W/cm$^2$, $10^{19}$ W/cm$^2$, $10^{20}$ W/cm$^2$, $10^{21}$ W/cm$^2$ therefore $\gamma < 1$ and the mechanisms involved are the second and in some cases the third mechanism. Therefore, when the leading edge of the radiation beam reaches the target it ionizes the atoms, such that the interaction between the radiation beam and the OPT is essentially with plasma.

In some embodiments, the patterned surface of the target substrate is a continuous surface and the pattern comprises grooves.

In some embodiments, the nanoscale features comprises discrete nanostructures which may be elongated.

For example, the nanoscale features have a characteristic width less than or about equal to at least one of 10λ; 5λ; χ; 0.5λ; 0.25λ; 0.1λ; 0.05λ; 1.02λ and a characteristic length greater than or about equal to at least one of χ; 2λ; 5λ, 10λ; 50λ; 100λ.

The inventors believe that the surface pattern of the targets acts as a field concentrator for the electric field of the electromagnetic radiation (e.g. light pulses) interacting with the target.

In particular, according to some embodiments of the invention, the surface pattern comprises a layer of filaments/nanowires characterized by a substantially uniform direction of orientation. In this case, the filaments may act as conductive needles concentrating and amplifying the laser electric field at their ends, like a macroscopic metal needle in an electric field generates an intense electric field at its point, or the local field enhancement measured at plasmon resonances.

In some embodiment of the invention, the surface pattern comprises nano-crescent shaped structures scattered on the substrate all aligned in the same direction. In this case, the nano-crescents can act as bent conducting needles concentrating and amplifying the laser electric field at their ends.

In some embodiments of the invention, the filaments are ice filaments. It should be noted that the terms "ice", "snow", and "$H_2O$ vapor" in the context of this patent application are used interchangeably all to refer to pattern features made from water vapor.

In some embodiments of the invention, the patterned surface has a thickness greater than or about equal to at least one of 1 μm; 10 μm; 20 μm; 50 μm; 100 μm; 500 μm.

In some embodiments, the target substrate is made of at least one of sapphire, silicon, carbon or plastics material.

In some embodiments, the target substrate is made by interacting the substrate with water vapor in a vacuum chamber while under biasing electric field across the substrate, thereby creating nanoscale features oriented along the electric field.

In some embodiments of the invention, the radiation beam comprises at least one pulse of laser light. Optionally, the pulse has duration less than or about equal to at least one of 1 ps; 0.5 ps; 0.2 ps; 0.1 ps; 0.03 ps.

In some embodiments of the invention, the invention enables a new way of employing "pre-pulses" for plasma production. A pre-pulse is an energy pulse that precedes the main plasma-producing pulse. In this connection, it should be noted that as noted above, it is commonly believed by those skilled in the art, as stated for example in U.S. Pat. No. 6,906,338, that a laser pulse that interacts with a target must be very clean temporally, i.e. with almost no or very low power pulses preceding the main pulse (called "pre-pulse"), such that no ionization damage would occur to the target before the main pulse interacts with it and suppress the proton/ion acceleration. Thus, according to the common knowledge, the pre-pulse needs to be removed or reduced to a minimum by using for example as suggested in U.S. Pat. No. 6,906,338 a thin foil layer that will absorb the pre-pulse before it reaches the target is. It should be noted that generally pre-pulses are an artifact of laser amplification and typically have intensities between and $10^{-3}$ and $10^{-14}$ that of a laser light pulse that they precede. Pre-pulses generally interfere with interaction of laser light pulses with matter in a target. A pre-pulse typically creates plasma on a surface of a target that reflects energy in the laser light pulse incident on the target surface following the pre-pulse and reduces thereby efficiency with which energy in the following light pulse couples to the target. However, it appears that pre-pulses accompanying laser pulses that interact with an OPT target, in accordance with an embodiment of the invention, are dissipated by ablation and ionization of a portion of the targets. The plasma created by a pre-pulse ablating and ionizing a portion of an OPT target, in accordance with an embodiment of the invention, is generally sub-critical density plasma, which does not interact strongly with energy in a subsequent pulse associated with, and following, the pre-pulse. As a result, the subsequent pulse is able to interact relatively efficiently with remaining, non-ablated, portions of the targets substantially without interference from plasma generated by the pre-pulse.

In some embodiments, the beam unit receives from an electromagnetic radiation source a radiation beam and provides a beam having a main pulse and a pre-pulse. Alternatively or additionally, the electromagnetic radiation source generates a beam having a main pulse and a pre-pulse.

As described above, more specifically, the inventors have experimentally found that pre-pulses having an intensity about equal to at least one of $10^{11}$ W/cm$^2$; $10^{12}$ W/cm$^2$; $10^{13}$ W/cm$^2$; $10^{14}$ W/cm$^2$; $10^{15}$ W/cm$^2$; $10^{16}$ W/cm$^2$ arriving between 1 ns to 100 ns prior to the main pulse, generates a plasma profile increasing the energy transfer to the ions and therefore the ion acceleration. The beam unit and/or the radiation source may control these intensities and the time period between the pre-pulse and the main pulse.

Although energy pulses in the form of laser pulses are preferred, other types of energy pulses are also conceivable, such as ultra short electron beam pulses. However, in the following description, energy pulses in the form of laser pulses will be taken as the preferred example. The electromagnetic radiation may be a laser light pulse which typically comprises a pre-pulse preceding the main pulse. However, the system of the present invention may also be used with laser systems reaching very low contrast ratios (i.e. the pre-pulse have intensities between of about $10^{-14}$ of the main pulse. The beam source or the beam unit may be controlled such that the pre-pulse may precede the pulse by a period between about 1 ns to about 100 ns. Preferably, the period is equal to or greater than about 6 ns. Additionally or alternatively, the surface pattern has a characteristic dimension greater than or about equal to a path length of the beam in the surface pattern sufficient to absorb substantially all the energy in the pre-pulse.

According to another broad aspect of the present invention, there is also provided a method for generating fast ions.

The method comprises irradiating a target substrate with a high power polarized coherent electromagnetic radiation beam, wherein the target substrate has a patterned surface with a pattern comprising nanoscale pattern features oriented substantially uniformly along a common orientation axis. A relation between the pattern and at least one parameter of the electromagnetic radiation is optimized by selecting at least one of an angle between a polarization direction of the beam of electromagnetic radiation and the orientation axis, and an incident angle for the beam of electromagnetic radiation, such that interaction between the radiation beam and the patterned surface of the substrate provides an efficient coupling between the radiation beam and the substrate resulting in generation of a fast ions' beam.

In some embodiments, the method comprises receiving the high power coherent polarized electromagnetic radiation beam and directing the radiation beam onto the surface of the target substrate at a desired grazing angle.

In some embodiments, the method comprises fabricating the target substrate by interacting a substrate with water vapor in a vacuum chamber while under biasing electric field across the substrate, thereby creating a target in the form of patterned substrate, the pattern having nanoscale features oriented in a predetermined substantially homogeneous direction along the electric field.

BRIEF DESCRIPTION OF THE DRAWINGS

In order to understand the invention and to see how it may be carried out in practice, embodiments will now be described by way of non-limiting example only, with reference to the accompanying drawings, in which.

DETAILED DESCRIPTION OF EMBODIMENTS

Figure 1A:
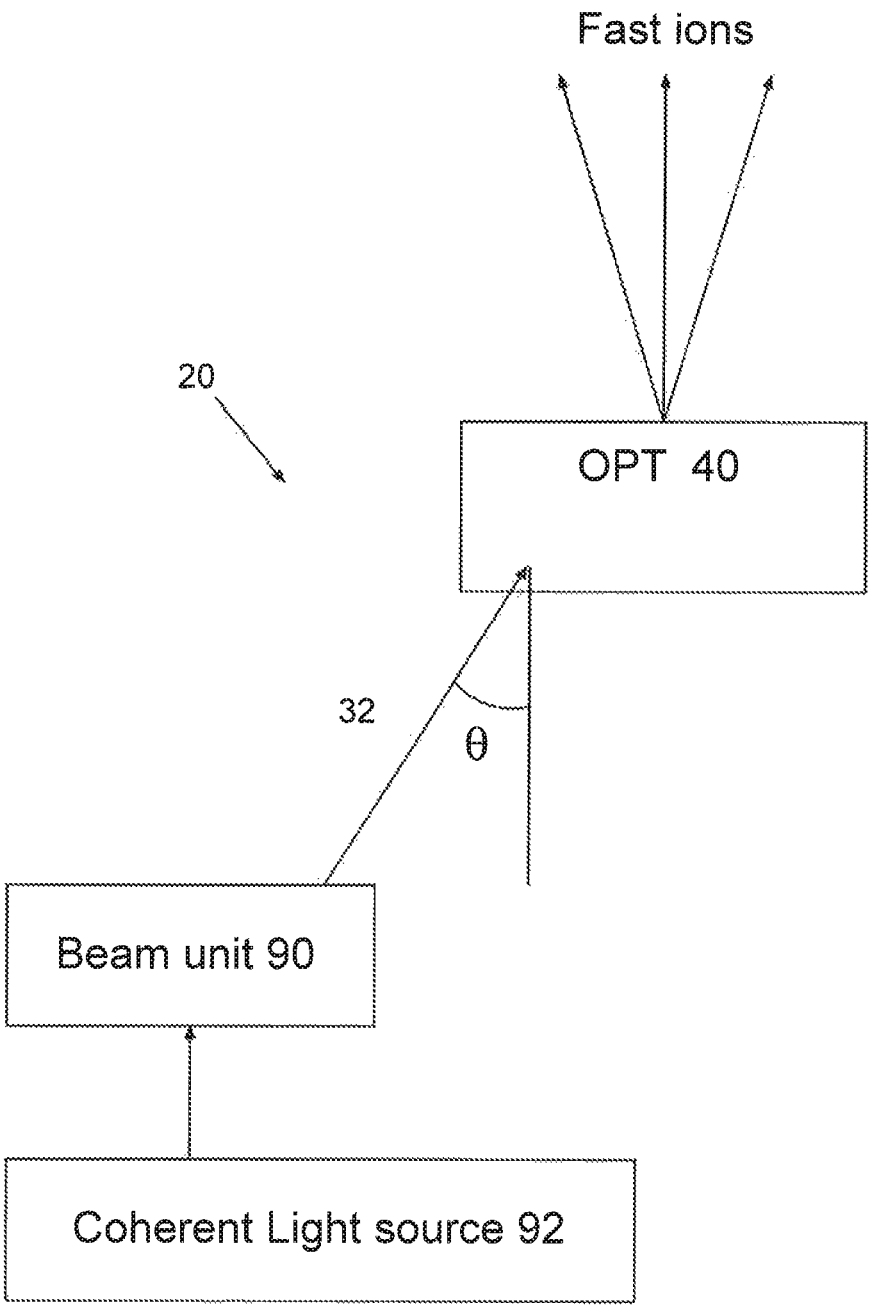
FIGS. 1A-1C schematically show general block diagrams of the system for generating fast ions and of a method thereof in accordance with some embodiments of the invention.
Figure 1B:
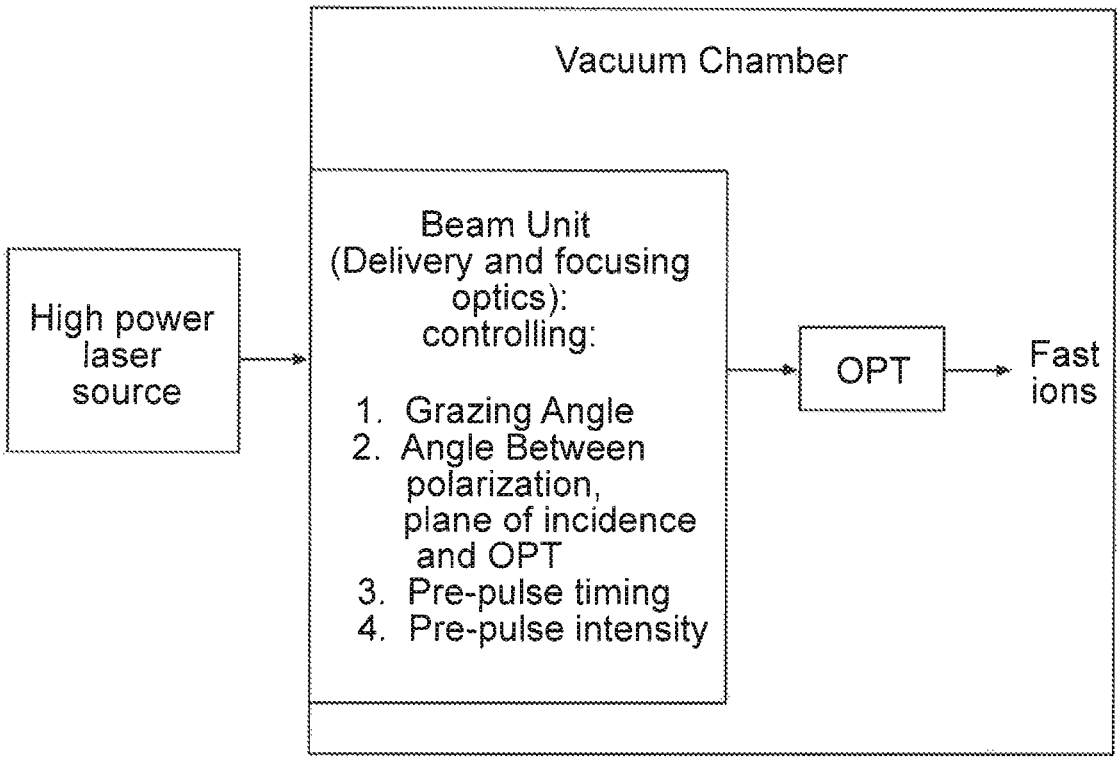
Figure 4:
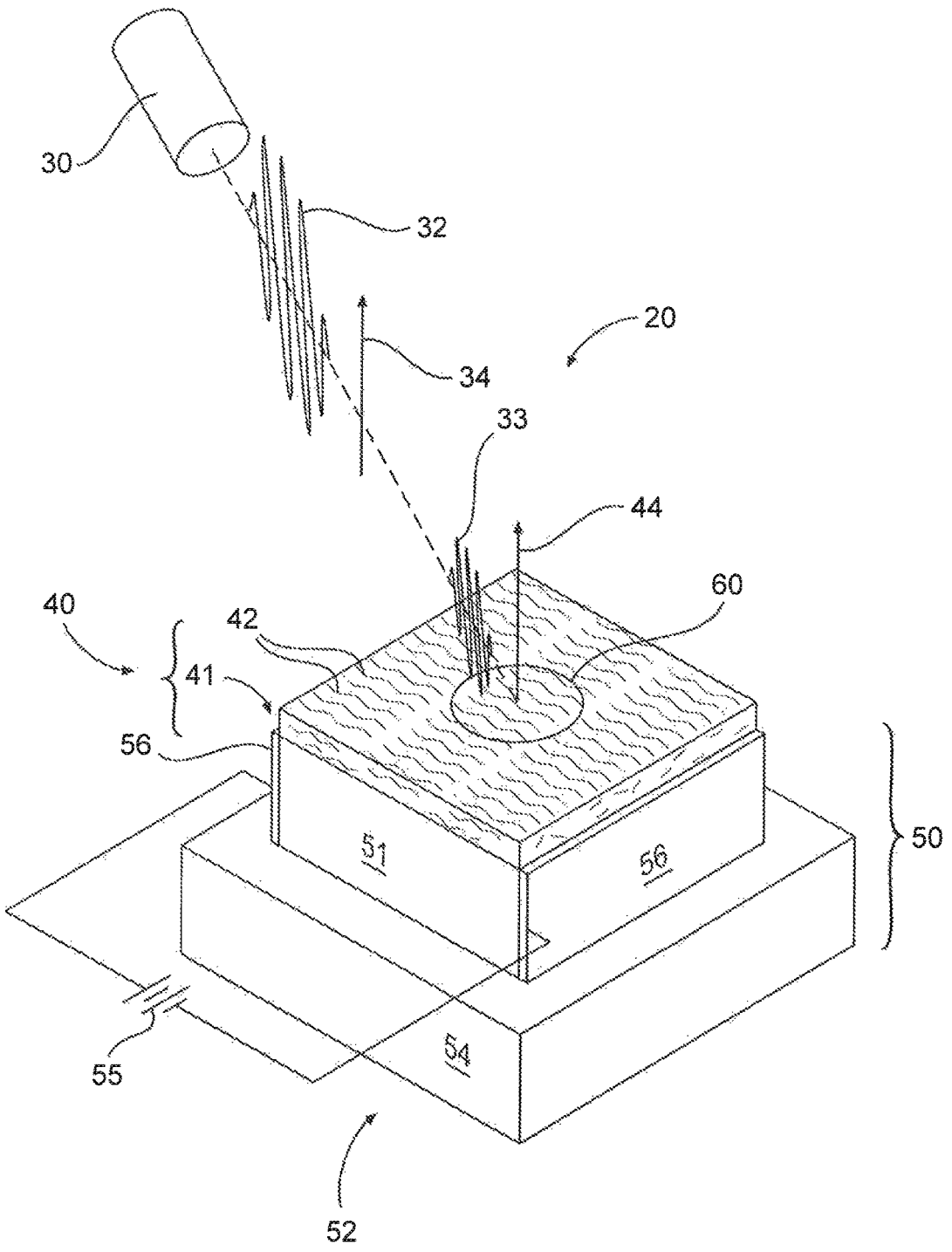
FIG. 4 schematically shows an example of the system for generating fast ions, in accordance with an embodiment of the invention.

FIG. 1A schematically shows a block diagram system for generating a beam of fast ions 20 comprising an oriented, patterned target (OPT) 40 interacting with an electromagnetic radiation 32, in accordance with an embodiment of the invention. The OPT substrate 40 has a surface pattern with sub-resonant nanoscale features oriented substantially homogeneous along a certain axis indicated by 44 (as illustrated in FIG. 4; i.e. having a predetermined substantially homogeneous direction of orientation). The system 20 comprises a beam unit to be used with a high power coherent electromagnetic radiation source 92 configured and operable to receive a high power coherent electromagnetic radiation beam and to direct a radiation beam having a predetermined polarization direction onto the surface of the target substrate at a desired grazing angle δ. An angle between a polarization direction of the beam of electromagnetic radiation and the orientation axis of the pattern features of the target substrate, and the grazing angle are selected such that interaction between the radiation beam and the substrate provides an efficient coupling between the radiation beam and the substrate enabling creation of fast ions. In particular, the polarization direction of the radiation beam is selected to be have a predetermined orientation with respect to the orientation axis of the substrate such that interaction between the radiation beam 32 and the substrate 40 provides an efficient coupling between the radiation beam and the substrate enabling creation of fest ions. The beam unit 90 is adapted for receiving a high power coherent electromagnetic radiation beam and providing an electromagnetic radiation beam having a main pulse and a pre-pulse and focusing it onto the patterned surface of the target substrate to cause interaction between the radiation beam and the substrate enabling creation of fast ions. FIG. 1B illustrates a flow chart of the process used according to the teachings of the present invention. The method for generating fast ions comprises irradiating an OPT with a high power polarized coherent electromagnetic radiation beam (e.g. high power laser source e.g. having a power of at least 10 TW) and optimizing a relation between the pattern of the OPT and at least one parameter of the electromagnetic radiation by selecting/controlling at least one of an incident angle (i.e. grazing angle) for the beam of electromagnetic radiation, an angle between a polarization direction of the beam of electromagnetic radiation and the orientation axis of the OPT, a pre-pulse timing and pre-pulse intensity, such that interaction between the radiation beam and the patterned surface of the OFT provides an efficient coupling between the radiation beam and the substrate resulting in generation of a fast ions beam.

As illustrated in the figure, in some embodiments, the beam unit is configured to control the intensity of the pre-pulse and/or the time period between the pre-pulse and the main pulse as well as the grazing angle for the beam of electromagnetic radiation, the angle between a polarization direction of the beam of electromagnetic radiation and the orientation axis of the OPT.

Figure 1C:
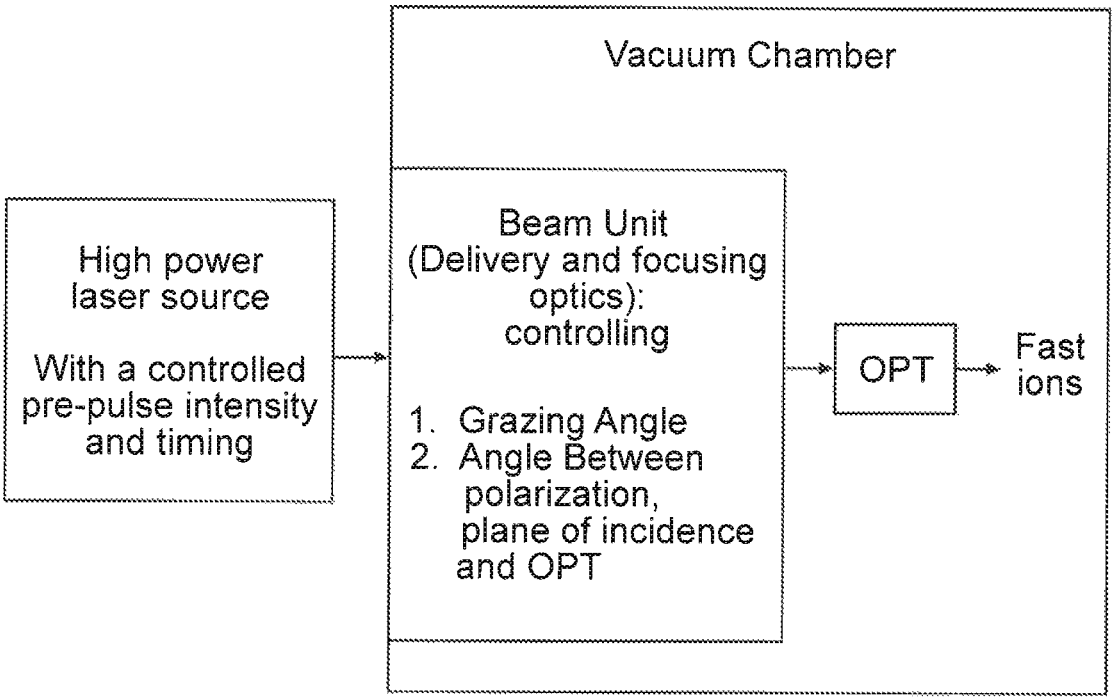

FIG. 1C illustrates a flow chart of the process used according to the teachings of the present invention. As illustrated in the figure, in some embodiments, the high power laser source is configured to control the intensity of the pre-pulse and/or the time period between the pre-pulse and the main pulse. The beam unit is configured to control the grazing angle for the beam of electromagnetic radiation, the angle between a polarization direction of the beam of electromagnetic radiation and the orientation axis of the OPT.

Figure 2:
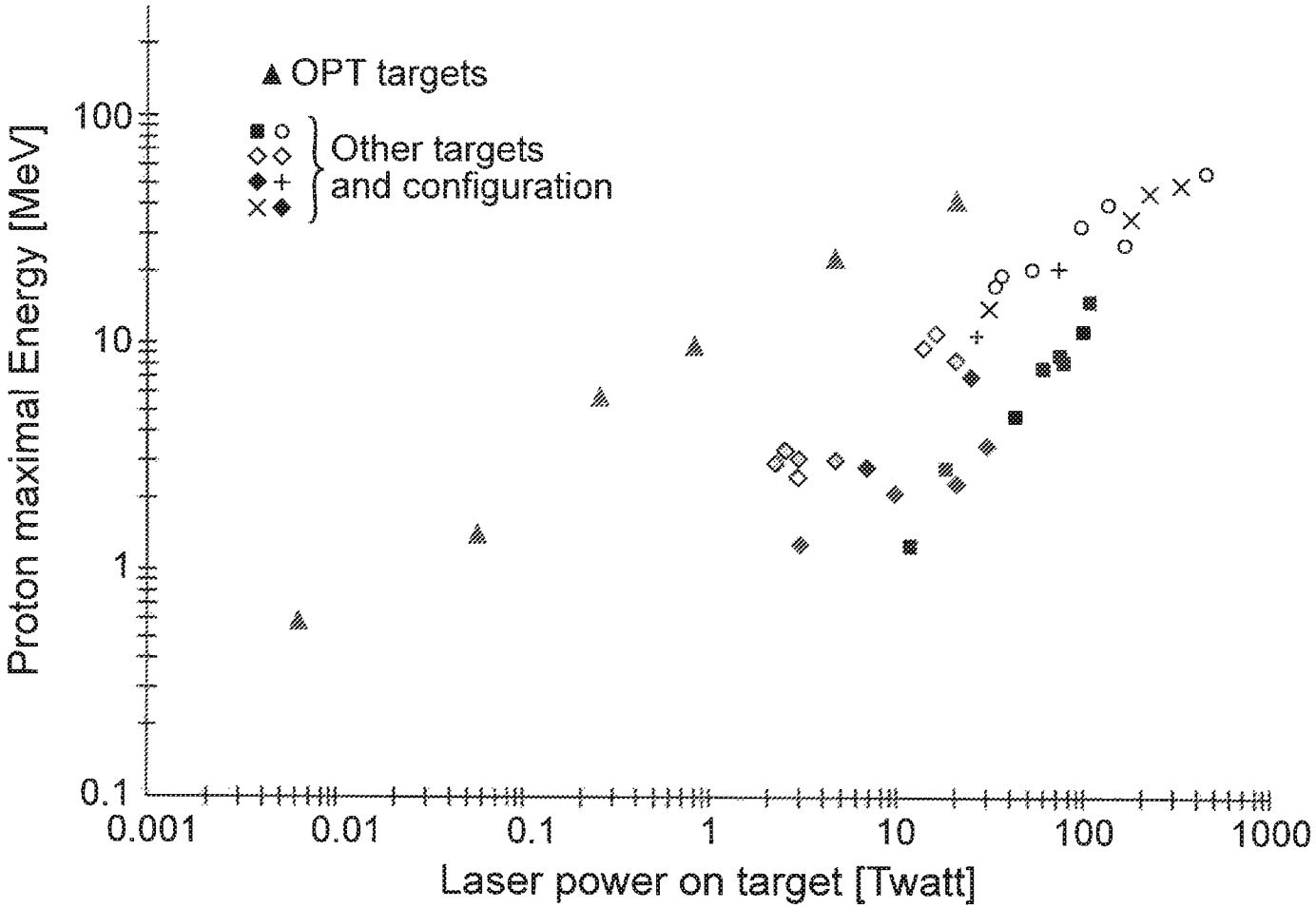
FIG. 2 graphically shows the interaction of different targets with the same radiation beam.

FIG. 2 graphically represents the resulting ions maximal energy of the interaction between a radiation beam and different laser-targets schemes, wherein the square, diamond, circles, X's and pulses are ions generated from solid and gas targets irradiated by high power short (>100 fsec) and ultrashort (<100 fsec) laser pulses and filled triangles are ions from an ultrashort laser and an OPT target.

The proton energy is approximately scaled as the square root of the laser intensity (i.e. $E_{protons} \sim I^{0.5}$). As clearly seen in the figure, OPT target (triangles) provides about an order of magnitude above the results obtained by the other targets (square and circles, X's and plus marks).

In a specific and non-limiting example, the OPT target is formed by $H_2O$ nanowires layed on a substrate of sapphire. The inventors have found that, when exposed, the target absorbs over 95% of incident light. The target also enhances the electric field associated with the interaction and acceleration of charged particles.

In some embodiments, the surface pattern of the targets acts as a field concentrator for the electric field of the electromagnetic radiation (e.g. light pulses) interacting with the target. In particular, according to some embodiments of the invention, the surface pattern comprises a layer of filaments/wires characterized by a direction of orientation. In this case, the filaments may act as conductive needles concentrating and amplifying the laser electric field at their ends, like a macroscopic metal needle in an electric field generates an intense electric field at its point. The geometrical dimensions of the narrow tips at the end of the wires generate a large charge-separation when irradiated by the electric field. As mentioned above, the high intensity laser pulse ionizes the wires. The charge separation induced by the wire geometry is locally added to the electric field of the laser interacting with the individual particles (electron and protons).

The main parameter for calculating the field enhancement is the geometrical ratio, g, which is the ratio between the diameter and length of a nanoscale feature.

The field enhancement factor (FEF) scales with g linearly, $$FEF = \frac{E_{enhanced}}{E_{laser}} \propto g.$$

Here $E_{laser}$ is the corresponding electric field to irradiated laser pulse and $E_{enhanced}$ is the effective electric field that is involved in the acceleration process of the ions.

Figure 3A:
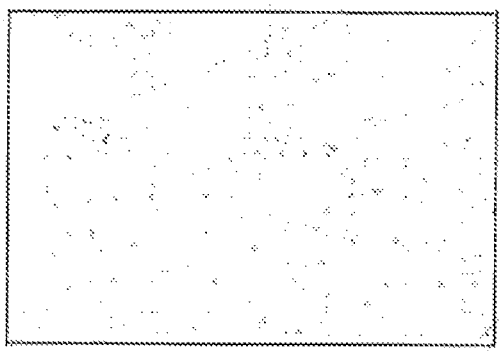
FIGS. 3A-3C shows the interaction of targets with a radiation beam at different grazing angles.
Figure 3B:
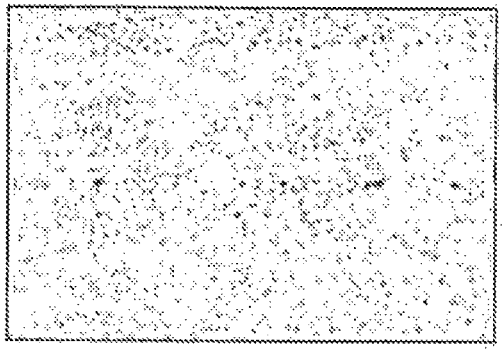
Figure 3C:
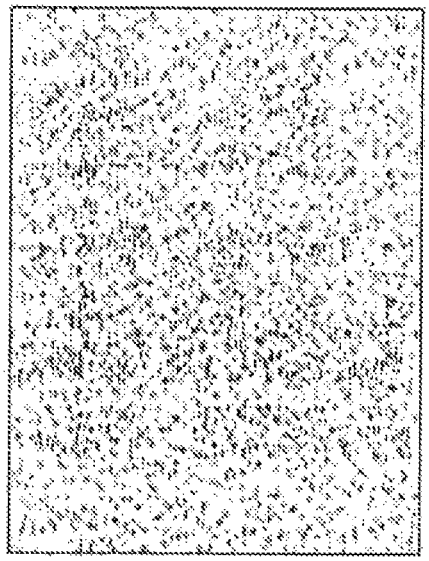

Reference is made to FIGS. 3A-3C illustrating protons generated by from the interaction of an OPT with incident electromagnetic beam at different angles of incidence. In this specific and non-limiting example, the ions energies are measured by CR39 plates covered with aluminum sheets blocking protons below certain energy. The black dots represent ion marks in the CR39. FIG. 3A represents the background level of the system for reference purpose. FIG. 3B represents the interaction between the target and an incident beam hitting the patterned surface with an incident angle of 45°. The protons energy cut-off is 0.5 MeV. The solid angle of the ions beam covered by the CR39 plates is about 34° (perpendicular to the target). FIG. 3C represents the interaction between the target and an incident beam hitting the patterned surface with an incident angle of 60° (i.e. grazing angle of 30°). The protons energy cut-off is 5 MeV. The solid angle covered by the CR39 plates is about 5° (perpendicular to the target). Therefore, it is clearly shown that the use of the OPT allows for optimizing parameter(s) of the incident electromagnetic radiation, incident angle in the present example, to enhance the efficiency of the radiation coupling into the OPT (e.g. energy cut-off and solid angle) contributing to creation of fast ions with high kinetic energy. The figures illustrate the optimization of the variation of the grazing angle of the electromagnetic beam onto the OPT surface. The incident angle should therefore be higher than 45° (small grazing angle) being an angle between the beam propagation axis and the normal to the OPT surface. In this specific example, the irradiation of the OPT at a grazing angle of about 60° generates a quantity of fast ions (e.g. protons) by at least a factor of 36. The fast ions beam has kinetic energy higher by at least a factor of 10. According to the teachings of the present invention, the optimal angle may be determined by appropriately varying gradually the grazing angle and measuring the properties of the generated fast ions beams. It should be understood that the actual value of the grazing angle depends inter alia on the pattern features e.g. the height of the grooves.

FIG. 4 schematically shows an example of a system for generating fast ions 20 comprising an oriented patterned target (OPT) 40 interacting with an electromagnetic radiation, in accordance with an embodiment of the invention.

The radiation beam 32 is directed towards a target 40 at a desired grazing angle δ8. The radiation beam 32 has a predetermined polarization direction indicated by an arrow 34. For example, the beam unit 30 is controllable to provide polarized laser beam pulses that are focused to a focal region in OPT 40 schematically indicated by a circle 60. In some embodiments, the beam unit 30 is controllable to provide a beam having a main pulse 32 and a pre-pulse 33.

In this specific and non-limiting example, the surface pattern of the OPT 40 comprises oriented filaments formed on and supported by a target pedestal 50. An arrow 44 indicates a direction of orientation that characterizes orientation of nanoscale features 42 and OPT 40. In an embodiment of the invention, polarization direction 34 is substantially parallel to direction 44 of orientation of OPT 40.

Pedestal 30 may comprise a sapphire substrate 51 coupled to a cooling unit 52 configured in accordance with any of various techniques known in the art. Optionally, cooling unit 52 comprises a Cu heat exchanger block 54 coupled to a liquid nitrogen circulation system (not shown) that pumps liquid nitrogen through the heat exchanger to remove heat from sapphire substrate 51. The substrate is sandwiched between bias electrodes 56 that are connected to a power supply 55. OPT 40 and pedestal 50 are located in a vacuum chamber (not shown).

To produce OPT 40, in accordance with an embodiment of the invention, pressure in the vacuum chamber is reduced to between about $5\times10^{-4}$ mBar to about $10^{-5}$ mBar and the cooling unit is operated to cool substrate 51 to about 80° K. Power supply 55 is controlled to apply a potential voltage between electrodes 56 that generates a biasing electric field in substrate 51, which is parallel to direction of orientation 44. Water vapor is then introduced into the vacuum chamber and condenses on substrate 51 in the form of elongated ice filaments 42. Because water is a polar molecule, as the molecules condense onto the substrate and grow ice filaments 42, the molecules, and the ice filaments tend to orient parallel to the electric biasing field and thereby direction of orientation 44. Other materials having the ability to be patterned, the pattern having nanoscale pattern features oriented substantially uniformly along a common axis, such as silicon, carbon or plastics (i.e. C—H composites) can also be used to form the target substrate having a substantially uniform direction of orientation according to the teachings of the present invention.

In some embodiments, the radiation beam 32 includes a beam pulse.

In an embodiment of the invention, water vapor is introduced into the vacuum chamber for a period long enough to grow layer 41 of surface pattern to thickness sufficient to absorb substantially all the energy in pre-pulse 33 and pulse 32. The pre-pulse 33 and main pulse 32 may be provided by the beam unit 90 and/or by a coherent light source 92 of FIG. 1. Pre-pulse 33 energy would therefore be dissipated by ablating and ionizing a portion of layer 41 and leave in place of the ablated material a relatively thin, sub-critical density, plasma overlaying a remaining portion of layer 41 prior to pulse 32 reaching the layer. The sub-critical density plasma does not interact strongly with energy in pulse 32, and as a result, energy in pulse 32 couples efficiently to the nanoscale features 42 in the remaining non-ablated portion of layer 41.

The presence of the electric field generated in substrate 51 would of course not result in all nanoscale features 42 that condense on the substrate being substantially aligned along direction 44. However, the electric field results in a density of aligned surface pattern (e.g. ice filaments) that characterizes layer 41 and OPT 40 with orientation direction 44. And it is expected that interaction of OPT 40 with pulse 33 of beam polarized in a direction, e.g. direction 34, parallel to direction of target orientation 44, in accordance with an embodiment of the invention, would be enhanced relative to interaction of the pulse with a non-oriented target T. Ion fluxes and energies provided by interaction of radiation beam (e.g. laser light pulse) with OPT 40 are therefore expected to be enhanced relative fluxes and energies provided by interaction of the light pulse with a T target.

The inventors have conducted experiments with a T target comprising a layer of non-oriented ice filaments interacting with intense, 800 nm wavelength laser light pulses to produce fast ions. An experiment conducted by the inventors was reported in the article entitled "Generation of Fast Ions by an Efficient Coupling of High Power Laser into Ice Nanotubes", referenced above. The experiments indicate that fluxes of 150 KeV protons are produced per laser light pulse having pulse width less than about 0.1 ps and "moderate" intensity of about $10^{16}$ W/cm$^2$ incident on a 1 mm thick T ice filament target formed on a target pedestal similar to pedestal 50. To produce same energy protons from conventional interaction of a laser light pulse and a solid, non-filamentary target, the laser pulse typically requires intensity of about $10^{17}$ W/cm$^2$, which is about an order of magnitude greater than that required using a T target.

In some embodiments of the invention, beam unit 30 focuses beam radiation 32 (e.g. laser light pulse) to a maximum intensity about equal to or greater than at least one of the followings: $10^{16}$ W/cm$^2$; $10^{17}$ W/cm$^2$; $10^{18}$ W/cm$^2$; $10^{19}$ W/cm$^2$; $10^{20}$ W/cm$^2$, $10^{21}$ W/cm$^2$.

Figure 5:
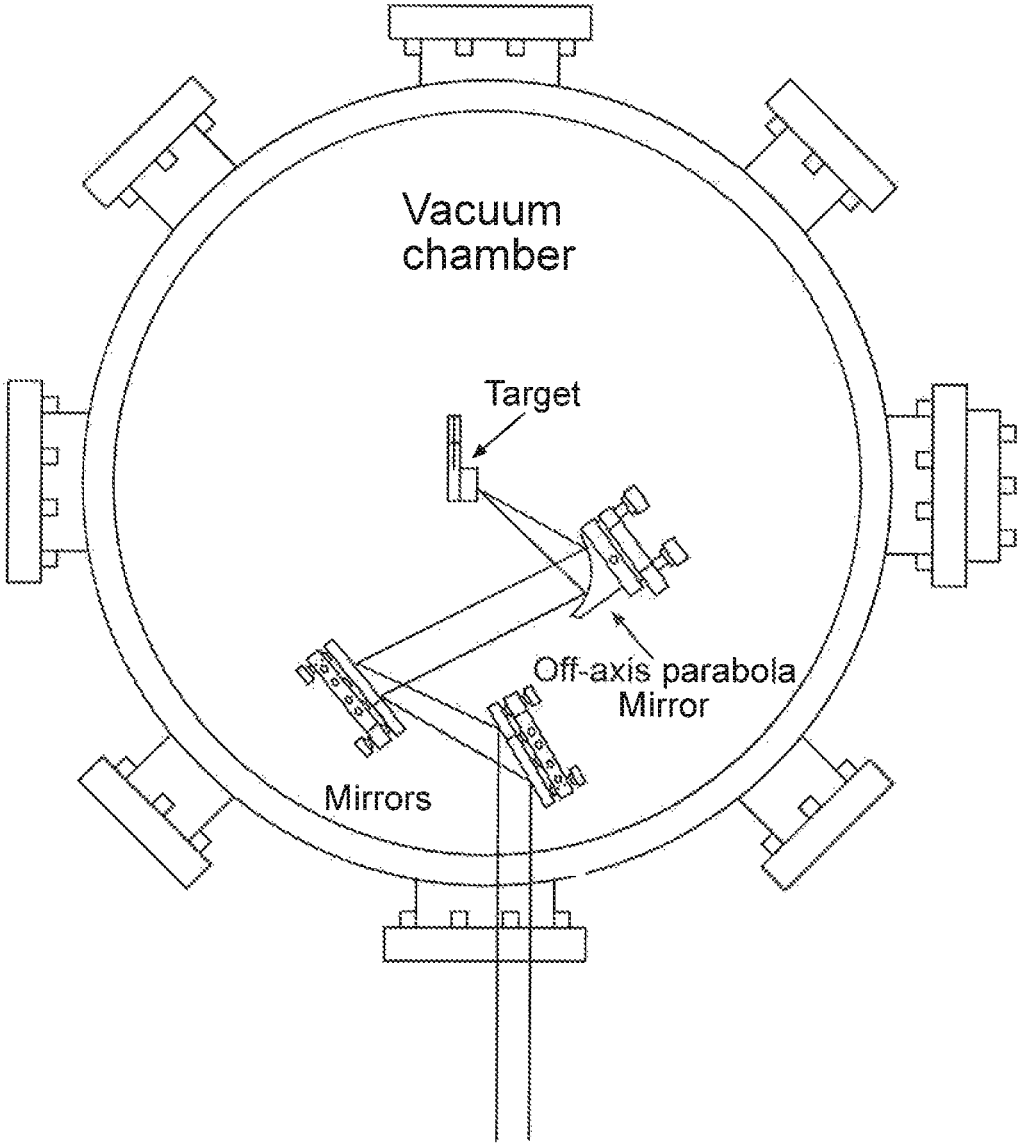
FIG. 5 schematically shows another example of the system for generating fast ions, in accordance with another embodiment of the invention.

FIG. 5 illustrates a configuration of an example of the system of the present invention in which, the beam unit comprise an arrangement of dielectric mirrors and of an off-axis parabola mirror (e.g. gold coated) configured and operable to focus the radiation beam to a focal region.

Figure 6A:
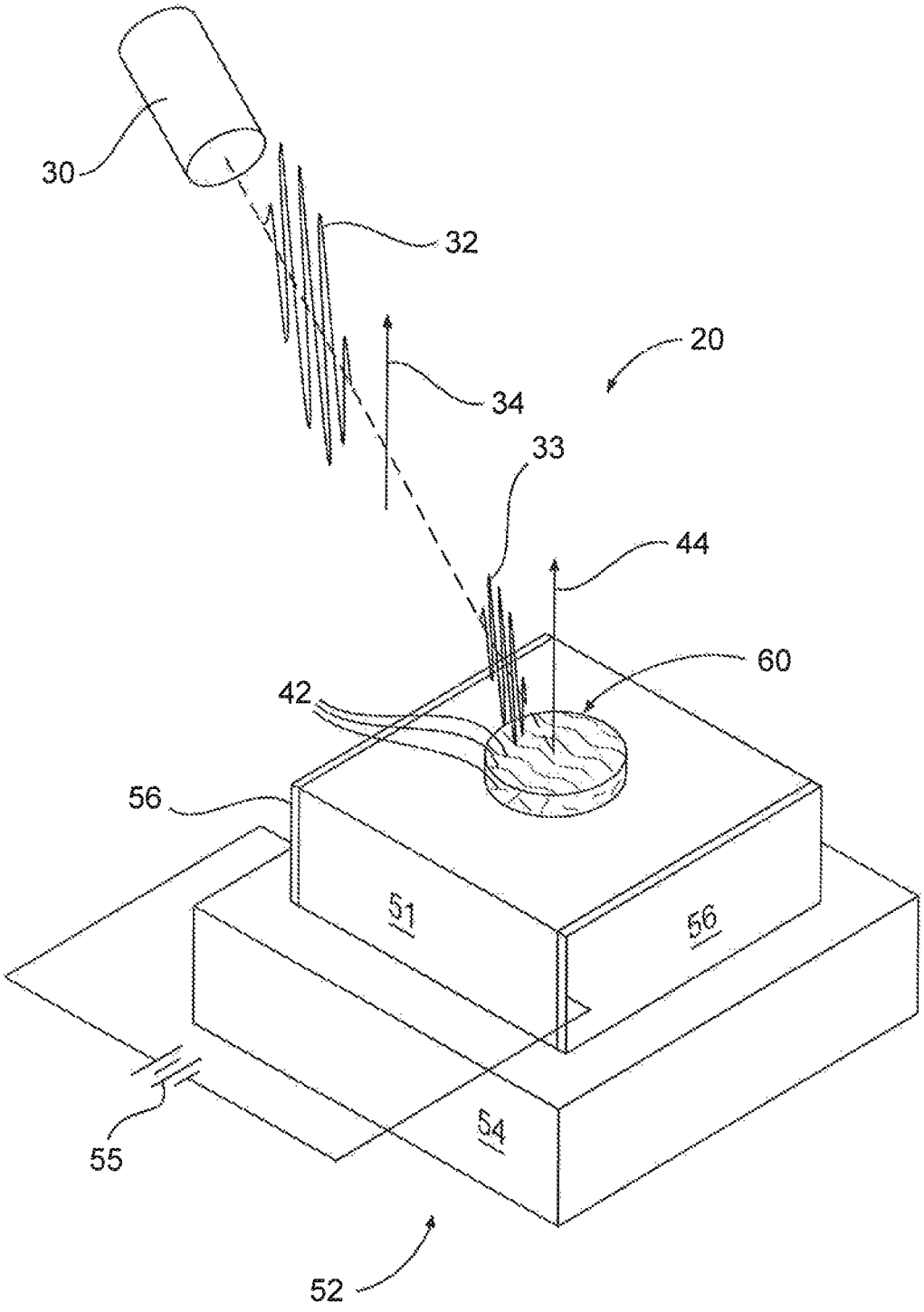
FIGS. 6A-6C schematically illustrate interaction of a polarized radiation beam with the target shown in FIG. 3, in accordance with an embodiment of the invention.
Figure 6B:
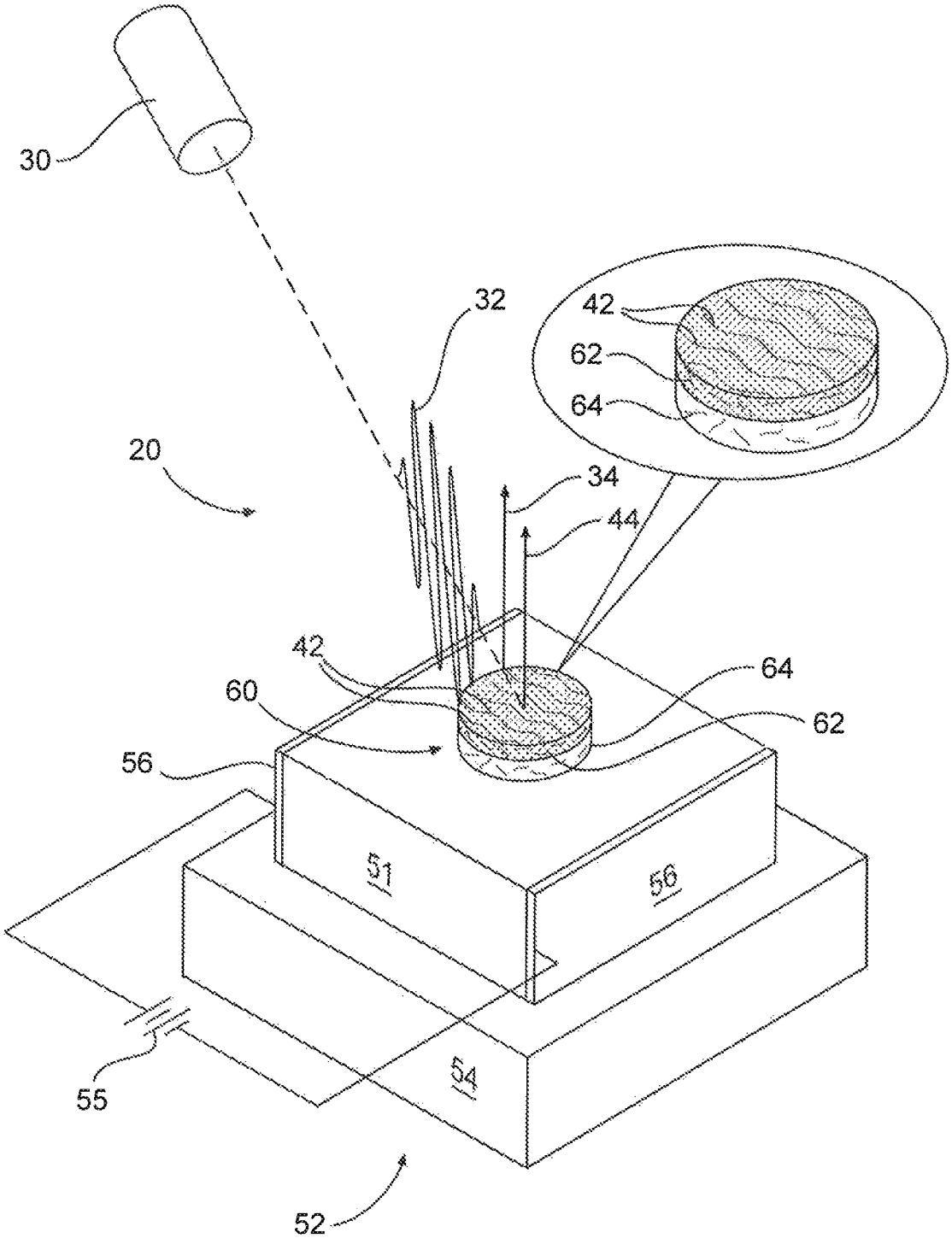
Figure 6C:
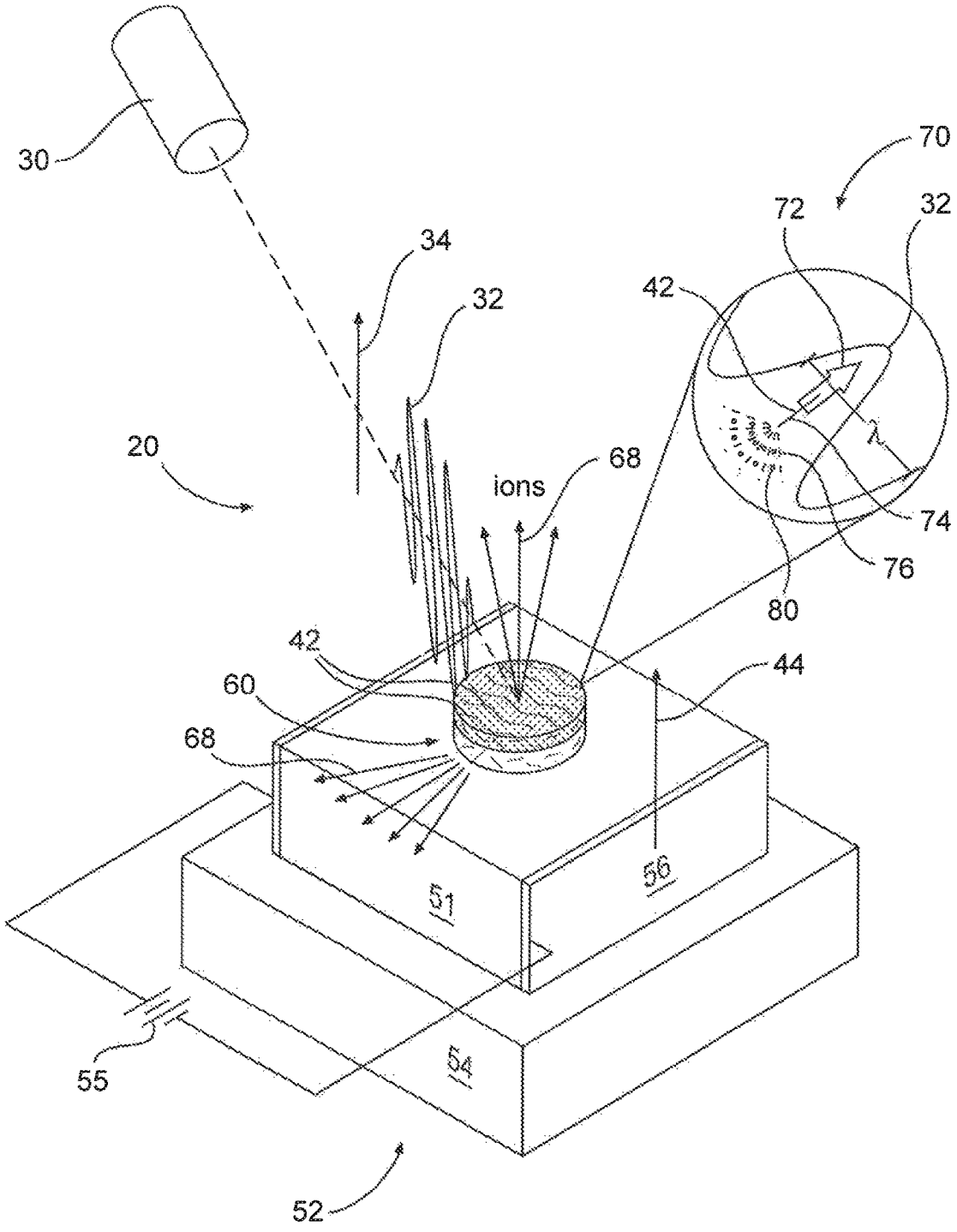

FIGS. 6A-6C schematically illustrate a process of generating fast protons, in accordance with an embodiment of the invention. In this specific and nom-limiting example, fast protons having an energy of about 50 MeV are produced by the system 20 of the present invention in which a radiation beam 32 (e.g. laser light pulse) is assumed to have a wavelength of 800 nm, pulse width of about 0.1 ps, and an intensity of about $5\times10^{19}$ W/cm$^2$ in a focal plane (when focused to focal region 60 of target OPT 40). Assuming a contrast ratio (ratio of pre-pulse intensity to main pulse intensity) of maximum $10^{-3}$, when focused to focal region 60, pre-pulse 33 has intensity equal to maximum $10^{16}$ W/cm$^2$. It should thus be understood that the energy of the pre-pulse and the position of the focal plane should be appropriately adjusted to on the one hand provide interaction at the desired energy of the beam for efficient coupling and on the other hand the focal plane energy should not be too high to not destroy the pattern features.

FIG. 6A schematically shows the system 20 of the present invention just before the interaction between the radiation beam and the OPT 20.

FIG. 6B schematically shows the system 20 of the present invention, after pre-pulse 33 has ablated and ionized, and has created a "burn off" layer having patterned nanoscale features 42 in focal region 60, leaving a sub-critical density plasma, represented by a shaded region 62. Plasma 62 overlays a remaining, non-ablated region 64 of nanoscale features 42 in focal region 60. In the figure, laser pulse 32 is just entering focal region 60. Because plasma is sub-critical it does not substantially affect laser pulse 32.

FIG. 6C schematically shows laser pulse 32 interacting with nanoscale features 42 in non-ablated region 64 (as illustrated in FIG. 6B) to produce a flux of protons schematically represented by a cluster of dot-dash arrows 68, in accordance with an embodiment of the invention.

Because the surface pattern has sub-resonant nanoscale features 42 e.g. the width of the surface pattern is much smaller than the wavelength of light in pulse 32, the electric field of the pulse, at any given moment is substantially constant within and in the neighborhood of the surface pattern. Without being bound by any particular theory, as mentioned before, the inventors believe that the surface pattern therefore acts similarly to a conducting needle in, and parallel to, an electric field, and concentrates the field at its tips, and that the concentrated field of a plurality of oriented nanoscale features 42 is particularly advantageous for generating a relatively large flux of fast protons. An inset 70 schematically shows nanoscale features 42 in the electric field of a localized region of pulse 32 smaller than a wavelength $\lambda$ of light in the pulse. A block arrow 72 represents the electric field of light pulse 32 near feature 42 and dashed field lines 76 converging towards a tip 74 of the feature schematically represent the concentrated field at the tip.

Concentrated field 76 generates a plume of hot electrons, schematically represented by circles 80, that leave feature 42 near its tip 74 by ionizing hydrogen and oxygen atoms (not shown) in the feature. The plume of electrons and ionized atoms in feature 42 produce an intense double layer field (not shown) that accelerates hydrogen ions in the filament to relatively high energies producing the flux of protons represented by cluster of arrows 68.

It is noted that efficacy with which light pulse 32 produces fast ions 68 by interacting with OPT 40 (FIG. 3) is responsive to direction 34 of polarization of light in pulse 32 relative to direction 44 of a nanoscale feature orientation in OPT 40 and/or to the direction of the plane of incidence. For example, as described above, the light pulse is particularly effective in producing a flux of fast ions, such as protons, when direction 34 and direction 44 of feature orientation are parallel or having a small angle between them. In some embodiments of the invention, magnitude and/or energy of ions produced by the system of the invention 20 is controlled by controlling the angle of polarization direction 34 relative to direction of feature orientation. By rotating polarization 34 away front the correct angle between polarization 34 and direction 44 of filament orientation, energy of protons is expected to decrease. Thus, an angle between the polarization direction and the orientation axis of the pattern can be appropriately adjusted to optimal value.

Figure 7:
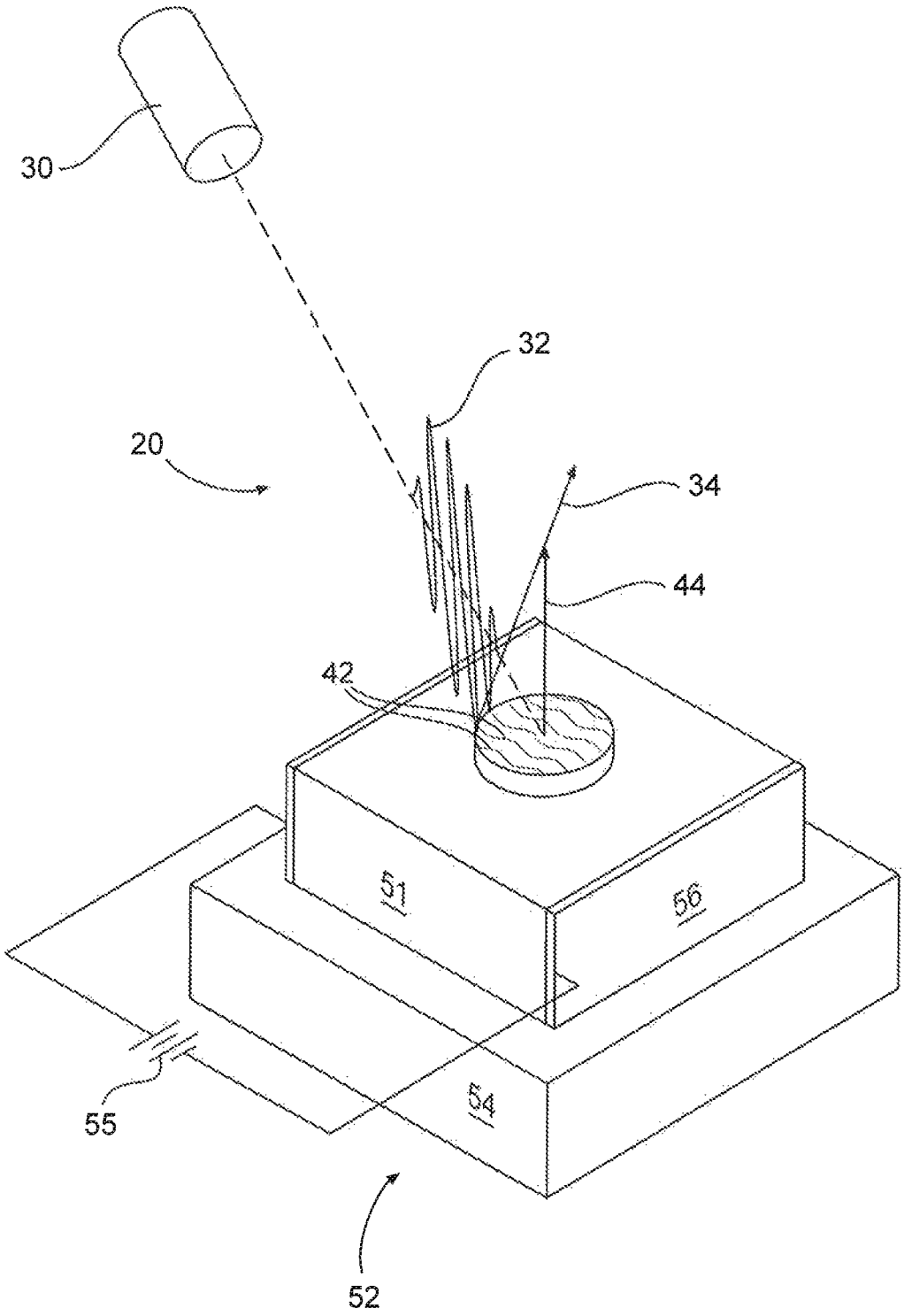
FIG. 7 schematically shows another configuration of a system for generating fast ions in accordance with an embodiment of the invention.

FIG. 7 schematically shows polarization of pulse 32 rotated, in accordance with an embodiment of the invention, away from direction 44 of features orientation.

The invention claimed is:

1. A system for generating a beam of fast ions, the system comprising;

a sapphire substrate having a patterned surface, a pattern comprising nanoscale pattern features oriented substantially uniformly along a common axis; and a beam unit configured to receive a high power coherent electromagnetic radiation beam and to focus it onto the patterned surface of a target substrate to cause interaction between the coherent electromagnetic radiation beam and the substrate supporting creation of a flow of fast ions; and wherein an angle of polarization direction of the high power coherent electromagnetic radiation beam is controlled relative to the orientation direction of filaments of an oriented patterned target (OPT), such that by rotating polarization direction of the high power coherent electromagnetic radiation beam relative to direction of filaments of OPT orientation, energy of fast ions is decreased; and wherein the sapphire substrate is coupled to a cooling unit including a heat exchanger block coupled to a liquid nitrogen circulation system that pumps liquid nitrogen through the heat exchanger block to remove heat from the sapphire substrate.

2. A system for generating a beam of fast ions, the system comprising;

a sapphire substrate having a patterned surface, a pattern comprising nanoscale pattern features oriented substantially uniformly along a common axis; and a beam unit configured to receive a high power coherent electromagnetic radiation beam and to focus it onto the patterned surface of a target substrate to cause interaction between the coherent electromagnetic radiation beam and the substrate supporting creation of a flow of fast ions; and wherein the sapphire substrate is coupled to a cooling unit including a heat exchanger block coupled to a liquid nitrogen circulation system that pumps liquid nitrogen through the heat exchanger block to remove heat from the sapphire substrate, wherein the sapphire substrate is sandwiched between bias electrodes connected to a power supply.

3. The system of claim 1 wherein a thickness of the sapphire substrate is 1 mm.

4. A system for generating a beam of fast ions, the system comprising;

a sapphire substrate having a patterned surface, a pattern comprising nanoscale pattern features oriented substantially uniformly along a common axis; and a beam unit configured to receive a high power coherent electromagnetic radiation beam and to focus it onto the patterned surface of a target substrate to cause interaction between the coherent electromagnetic radiation beam and the substrate supporting creation of a flow of fast ions; and a power supply configured to apply a potential voltage between electrodes that generates a biasing electric field in the sapphire substrate, the electric field being parallel to direction of nanoscale pattern features, wherein the sapphire substrate is coupled to a cooling unit including a heat exchanger block coupled to a liquid nitrogen circulation system that pumps liquid nitrogen through the heat exchanger block to remove heat from the sapphire substrate.

5. The system of claim 1 wherein the high power coherent electromagnetic radiation beam is polarized and wherein polarization direction of the high power coherent electromagnetic radiation beam is substantially parallel to direction of orientation of filaments of oriented patterned targets (OPT) features.

6. The system of claim 1 wherein the nanoscale pattern features oriented substantially uniformly along a common axis comprise elongated clusters with characteristic size of 0.01-0.1 micron.

7. The system of claim 1 wherein the sapphire substrate is sandwiched between bias electrodes connected to a power supply.

* * * * *